US007676860B2

(12) United States Patent
Cheng

(10) Patent No.: US 7,676,860 B2
(45) Date of Patent: Mar. 16, 2010

(54) SECURITY FASTENING STRUCTURE OF A BASE OF A BABY BED FOR BABIES TO PLAY IN

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 12/068,375

(22) Filed: Feb. 6, 2008

(65) Prior Publication Data

US 2009/0193581 A1 Aug. 6, 2009

(51) Int. Cl.
*A47D 13/06* (2006.01)

(52) U.S. Cl. ..... 5/99.1

(58) Field of Classification Search ..... 5/93.1, 5/98.1, 99.1, 178–180
See application file for complete search history.

(56) References Cited

U.S. PATENT DOCUMENTS 6,170,099 B1 * 1/2001 Cheng ..... 5/99.1

* cited by examiner

*Primary Examiner*—Fredrick Conley
(74) *Attorney, Agent, or Firm*—Rosenberg, Klein & Lee

(57) ABSTRACT

A baby bed includes a base member arranged on a middle of a bottom of a frame thereof; the frame includes two connecting rods, which will extend along a same diagonal line of the bottom of the frame after the baby bed is expanded; two stopped components are joined on inward ends of the connecting rods respectively, and a stopping bar mechanism is pivoted on a middle of the base member; an elastic element is fitted on the stopping bar mechanism to bias the stopping bar mechanism into a stretched state; the stopped components will come into contact with the stopping bar mechanism to prevent the connecting rods from bouncing when the baby bed is in expanded configuration; the stopping bar mechanism will be apart from the stopped components to allow the baby bed to be folded after the stopping bar mechanism is pivoted with its upper ends moving upwards.

3 Claims, 7 Drawing Sheets

SECURITY FASTENING STRUCTURE OF A BASE OF A BABY BED FOR BABIES TO PLAY IN

BACKGROUND OF THE INVENTION

1. Field of the Invention

The present invention relates to a security fastening structure of a base of a baby bed, more particularly one, which can make the baby bed relatively firm in an expanded in-use configuration, and will allow the baby bed to be easily changed into a folded configuration.

2. Brief Description of the Prior Art

Referring to FIGS. 6 and 7, a currently existing baby bed includes a main body 3, which comprises several upright rods 313 on the periphery. Each of the upright rods 31 has a foot member 32 secured on a lower end thereof. Connecting rods 33 are pivoted to the foot members 32 respectively at a first end thereof. The baby bed further includes a base member 34, and the connecting rods 33 are each pivoted to the base member 34 at a second end thereof.

The base member 34 has cavities 341 on a periphery thereof, and the second ends of the connecting rods 33 are received in the cavities 341 respectively. The base member 34 is equipped with a rotary handle 342 on an upper side thereof to fasten the connecting rods 33. And, a mattress 35 is positioned on the base member 34. The rotary handle 342 can be rotated between a fastening position and a loosening one. When the baby bed is in an expanded configuration, the connecting rods 33 will be in a laid-down position, and fastened by means of the rotary handle 342. After the rotary handle 342 is rotated to the loosening position, the connecting rods 33 can be pivoted downwards relative to the base member 34 so as to move the baby bed to a folded configuration.

The above baby bed is found to have a drawback: It takes relatively much labor to fold the baby bed; the user has to first turn the rotary handle 342 about the Y-axis to the loosening position, and next lift the rotary handle 342 in order for the baby bed to change into the folding configuration. In other words, the baby bed can't be used very conveniently, and therefore there is room for improvement.

Therefore, it is a main object of the present invention to provide an improvement on a security fastening structure of a base of a baby bed to overcome the above problem.

SUMMARY OF THE INVENTION

A baby bed according to an embodiment of the present invention includes a base member arranged on a middle of a bottom of a frame thereof. The frame includes two connecting rods, which will extend along a same diagonal line of the bottom of the frame after the baby bed is expanded. Two stopped components are joined on inward ends of the connecting rods respectively. A stopping bar mechanism is pivoted on a middle of the base member. A pulling cord is joined to two upper ends of the bar mechanism while an elastic element is fitted on the bar mechanism to bias the bar mechanism into a stretched state. The stopped components will come into contact with the stopping bar mechanism to prevent the connecting rods from bouncing when the baby bed is in expanded configuration; thus, the baby bed is firm. The bar mechanism will be apart from the stopped components to allow the baby bed to be folded after the pulling cord is pulled upwards to raise the upper ends of the bar mechanism. Therefore, the baby bed can be changed into a folded configuration merely by means of pulling the cord upwards.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
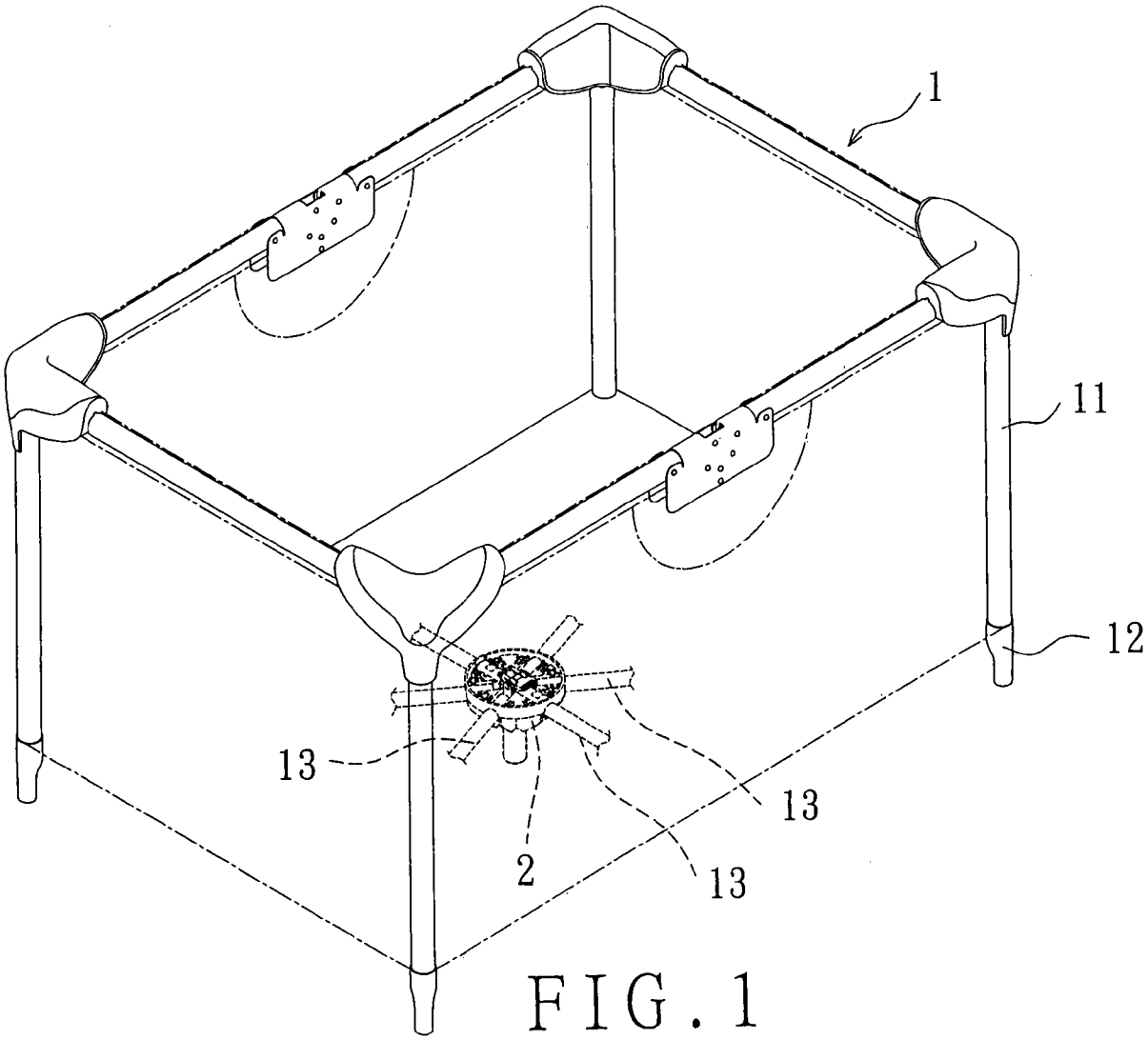
FIG. 1 is a perspective view of a baby bed according to the present invention.

Referring to FIG. 1, a preferred embodiment of a baby bed of the present invention consists of a frame 1, and a base member 2. The frame 1 consists of four upright rods 11, foot members 12, and connecting rods 13; the foot members 12 are each joined to a lower end of one of the upright rods 11; the connecting rods 13 are each pivoted to one of the foot members 12 at an outward end thereof.

The base member 2 is arranged on a middle portion of a bottom of the frame 1, and the connecting rods 13 are pivoted to the base member 2 at inward ends thereof.

Figure 2:
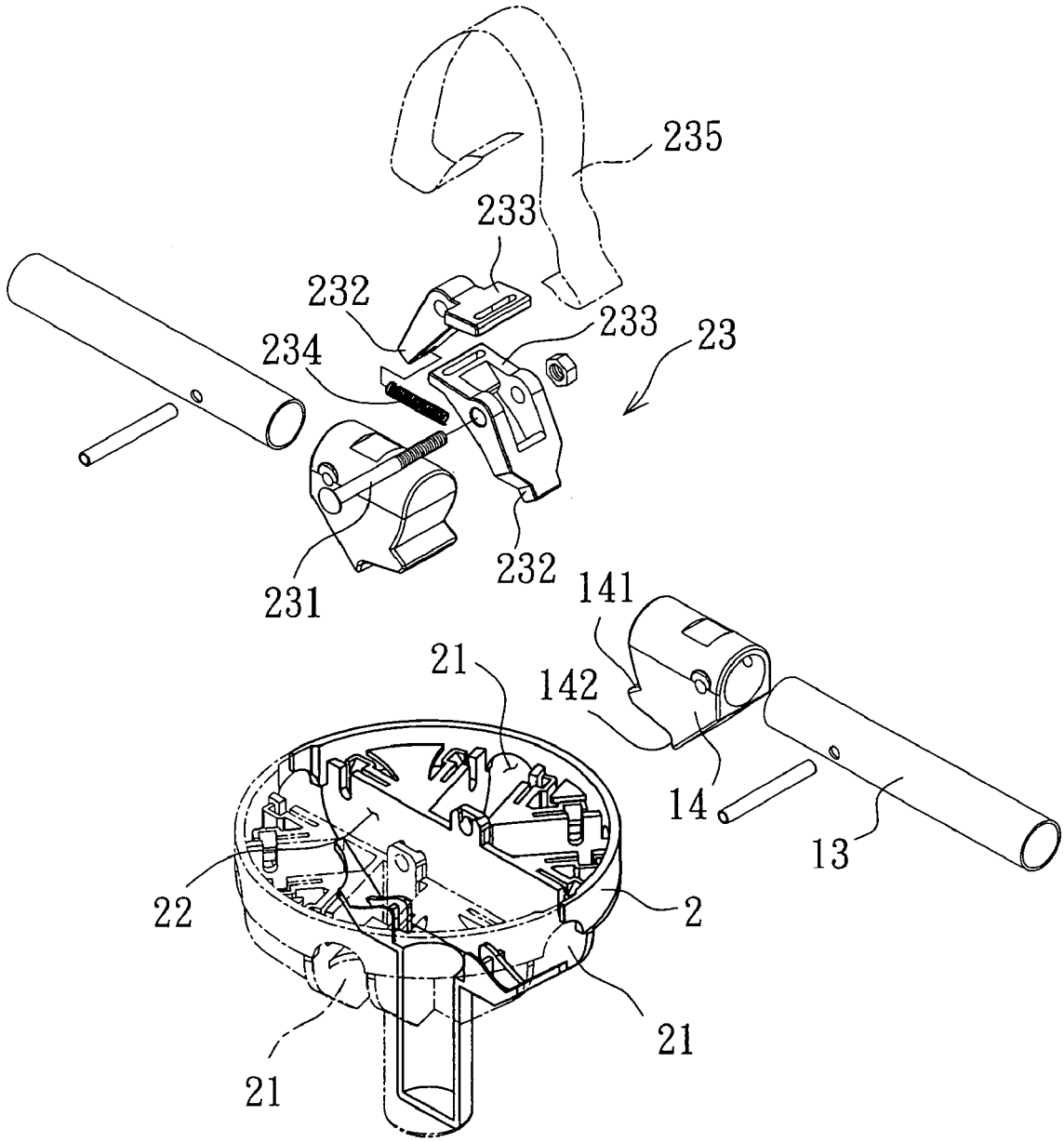
FIG. 2 is an exploded perspective view of the security fastening structure in the present invention.

Referring to FIG. 2 as well, the base member 2 has four pivotal hollow portions 21 on a periphery thereof; first and second ones of the pivotal hollow portions 21 are on a first diagonal line of the bottom of the frame 1. The base member 2 has a locating hollow portion 22, which communicates with the first and the second pivotal hollow portions 21 at two ends thereof. First and second ones of the connecting rods 13 are on said first diagonal line of the bottom of the frame 1, and each have a stopped component 14 joined on its inward end; the stopped components 14 are received in and pivoted to the first and the second pivotal hollow portions 21 of the base member 2 respectively so that the first and the second connecting rods 13 can pivot on the base member 1; the other two connecting rods 13 are received in and pivoted to the other two pivotal hollow portions 21 of the base member 2 at their inwards ends. Each of the stopped components 14 has an inward fastening portion 141, and a bottom propping portion 142.

Two stopping bars 23 are pivoted at middle portions thereof to the middle portion of the base member 2 by means of a pivotal piece 231, with lower ends of the stopping bars 23 being received in the locating hollow portion 22. The stopping bars 23 each have a bottom stopping portion 232, and will be in a fastening position to come into contact with the fastening portions 141 of the stopped components 14 at the bottom stopping portions 232 thereof so as to make the baby bed firm when the baby bed is in an expanded in-use configuration, as shown in FIG. 3.

The baby bed will be changed into a folded configuration if the connecting rods 13 are pivoted upwards relative to the upright rods 11 of the frame 1 after the stopping bars 23 have been pivoted away from the fastening position to no longer contact the fastening portions 141 of the stopped components 14.

Furthermore, each of the stopping bars 23 has an upper operating end 233, which normally faces lateral portions of the baby bed and in opposite directions, and a pulling cord 235 is joined to the upper operating ends 233 of the stopping bars 23 at two ends thereof. An elastic element 234 is positioned between and joined to the lower ends of the stopping bars 23 at two ends thereof.

Figure 3:
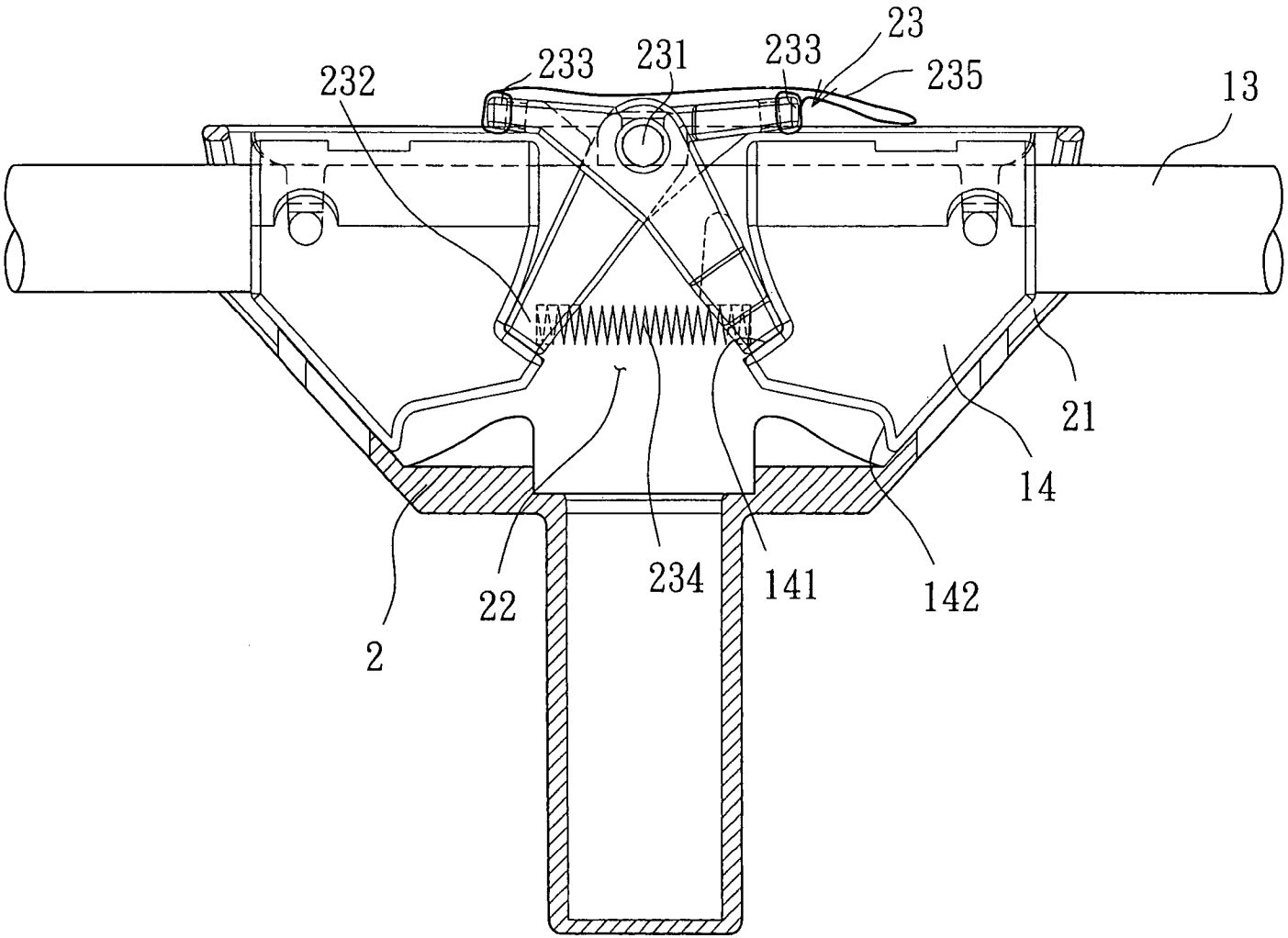
FIG. 3 is a sectional view of the present invention, taken when the baby bed is in the expanded configuration.
Figure 4:
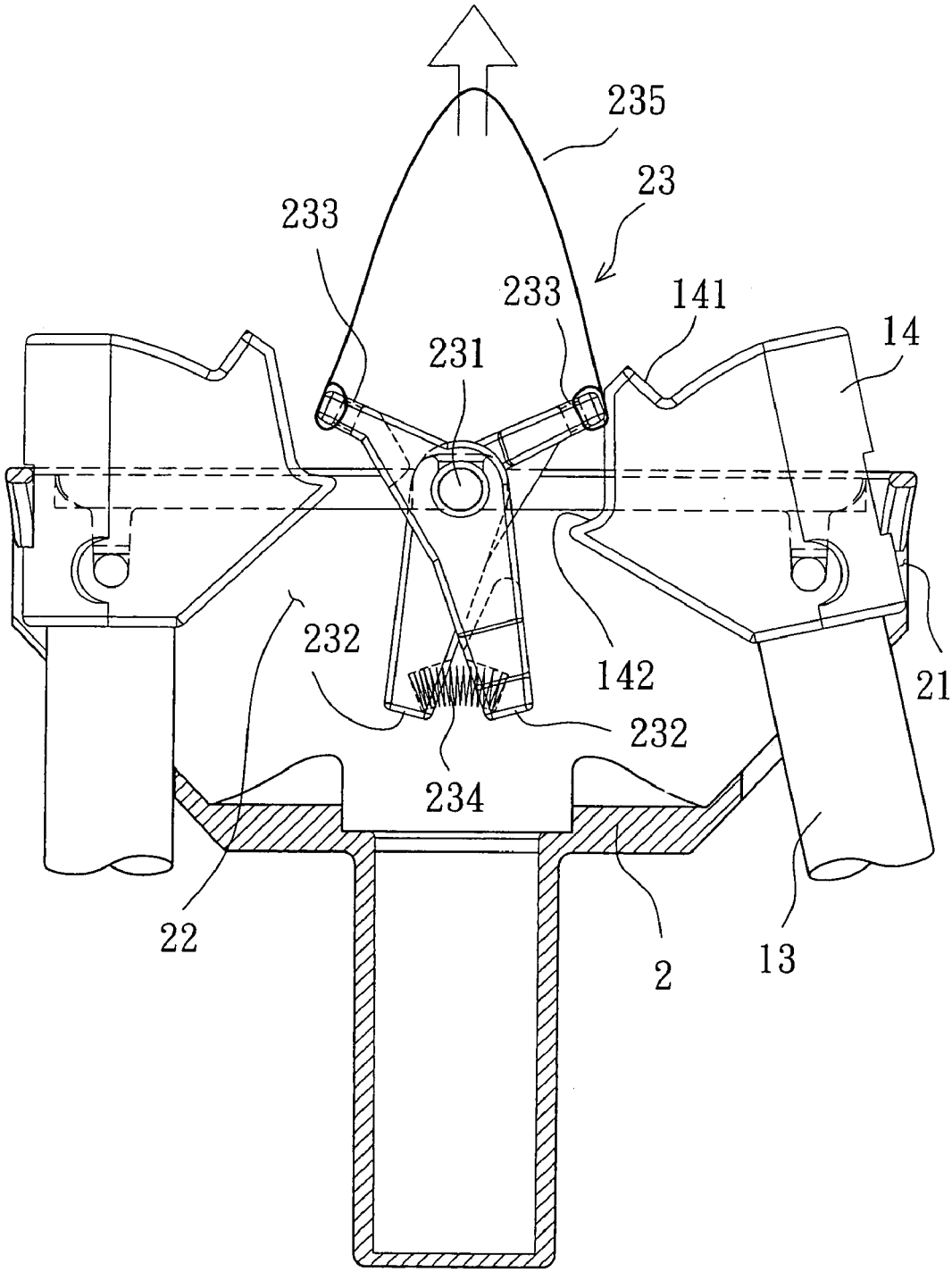
FIG. 4 is a sectional view of the present invention, taken when the baby bed is moved to the folded configuration.

Therefore, the stopping bars 23 are usually forced to stay in the fastening position, with the bottom stopping portions 232 thereof being farther apart from each other, by means of the elastic element 234, as shown in FIG. 3. And, referring to FIG. 4, the stopping bars 23 will be pivoted on the pivotal piece 231 to a non-fastening position, with the elastic element 234 being compressed, when the pulling cord 235 is pulled upwards to lift the upper operating ends 233 of the stopping bars 23; thus, the stopped components 14 are no longer stopped by the stopping bars 23, and the connecting rods 13 are free to pivot upwards relative to the upright rods 11 of the frame 1 in order for the baby bed to fold. Furthermore, referring to FIG. 5, the upper operating ends 233 of the stopping bars 23 will be propped on the propping portions 142 of the stopped components 14 after the baby bed is changed into the folded configuration.

Figure 5:
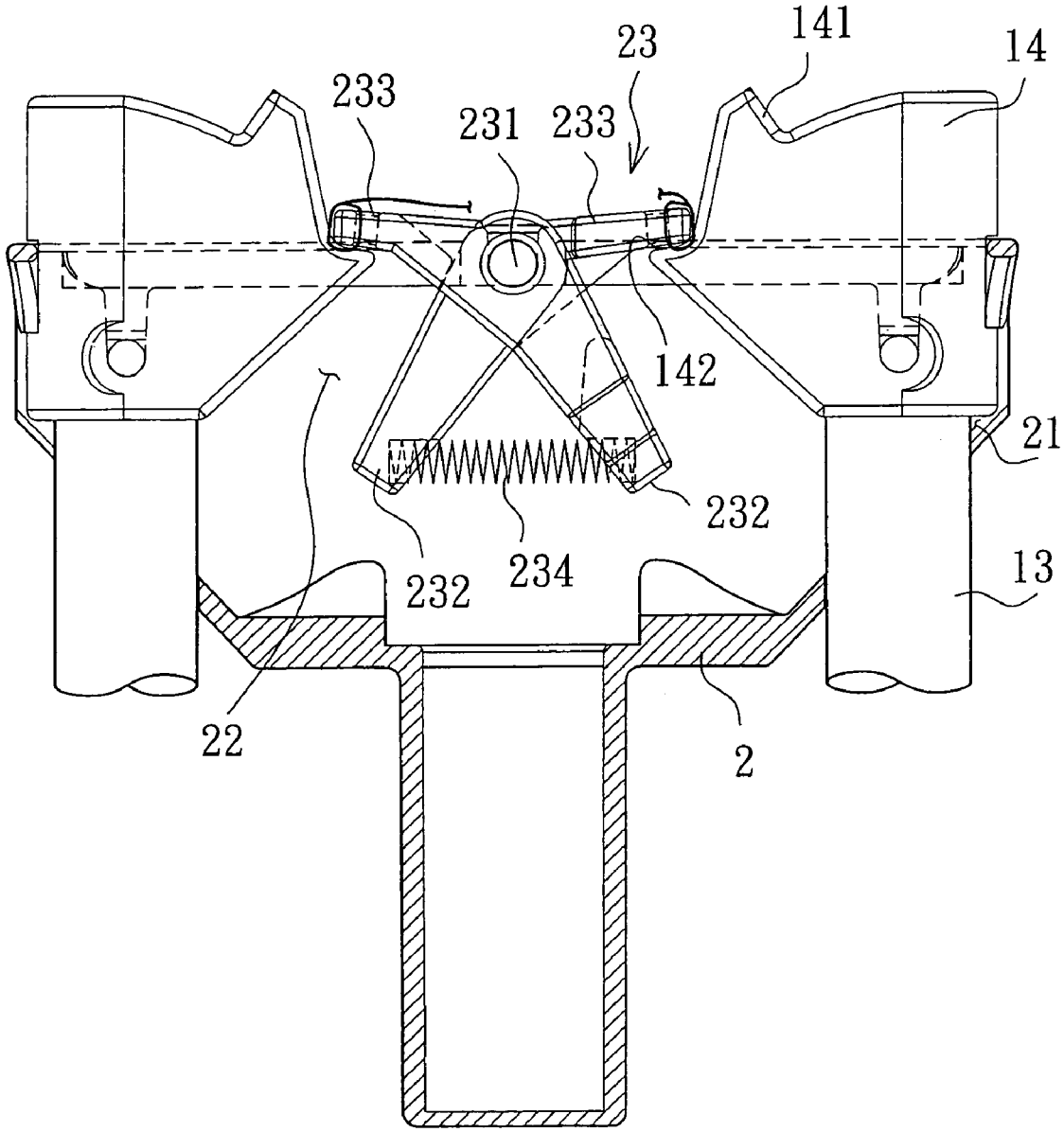
FIG. 5 is a sectional view of the present invention, taken when the baby bed is in the folded configuration.
Figure 6:
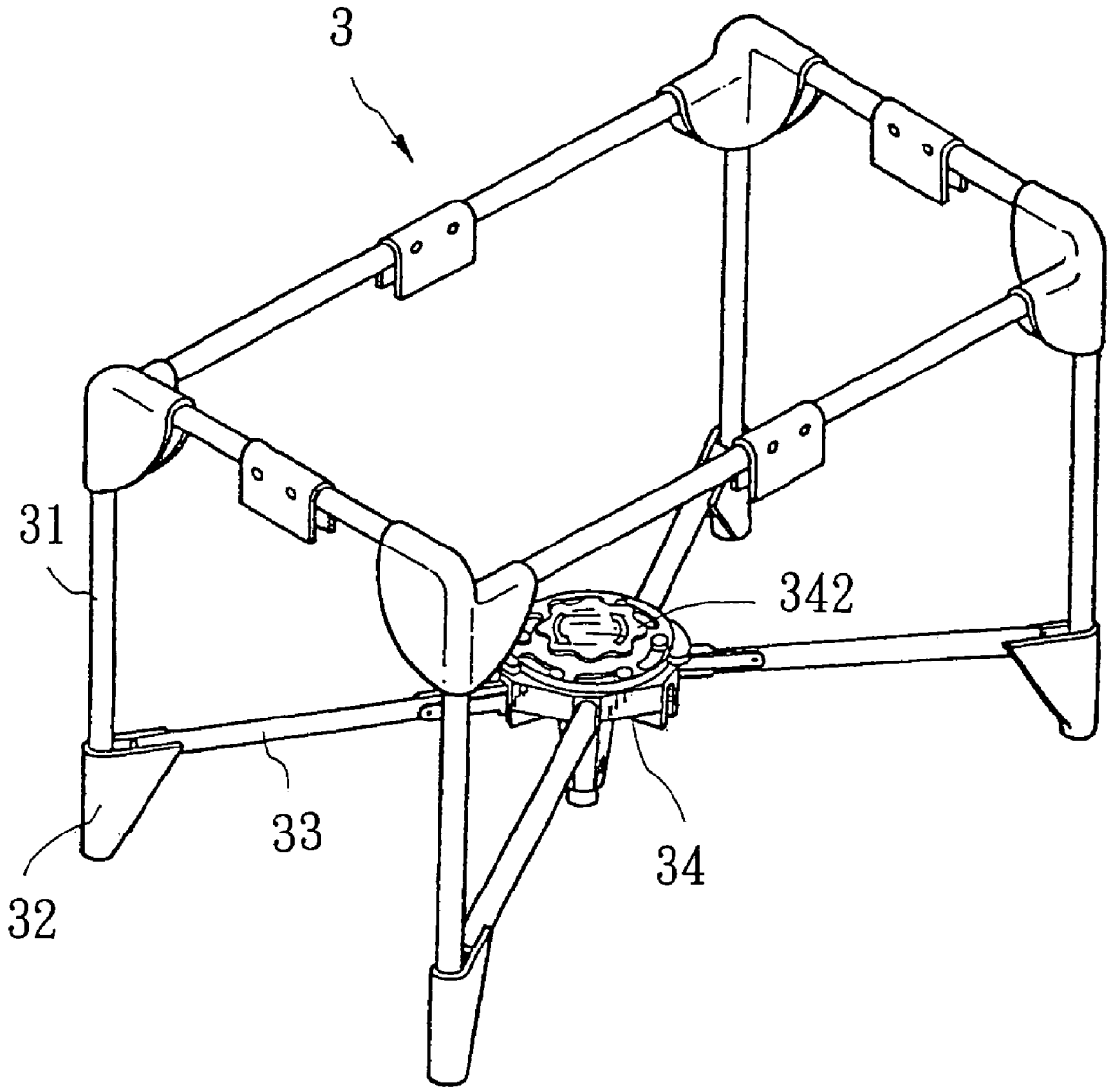
FIG. 6 (PRIOR ART)
FIG. 6 is a perspective view of the prior art.
Figure 7:
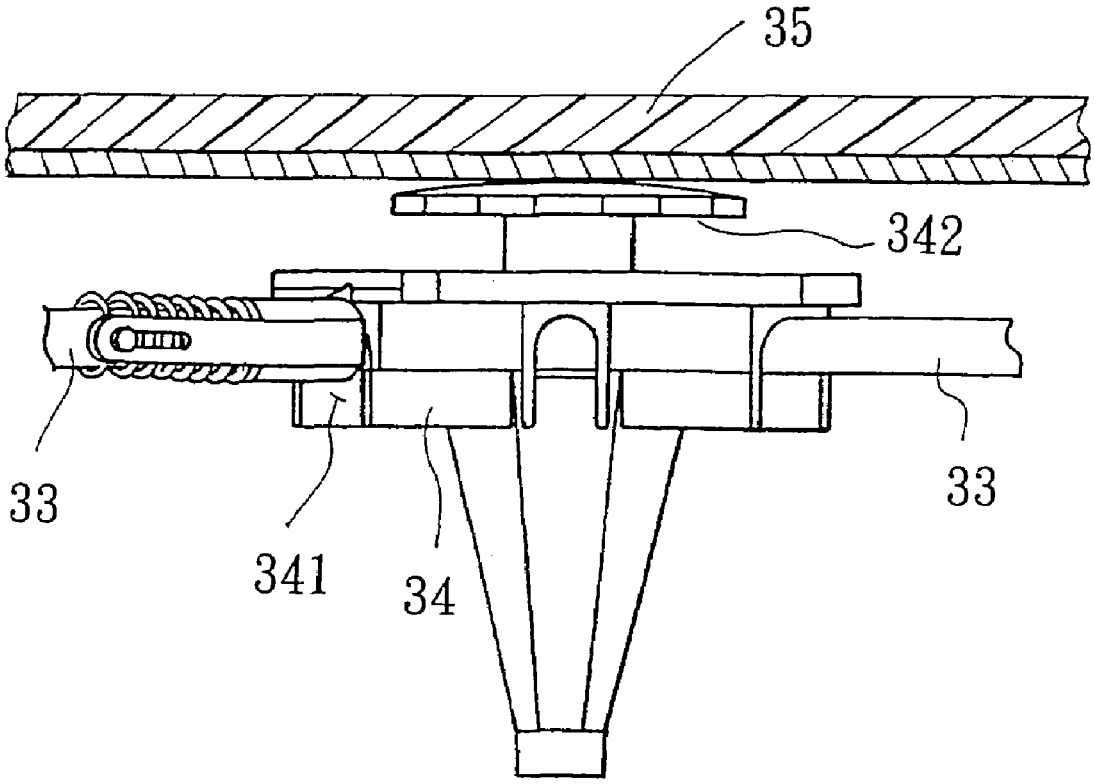
FIG. 7 (PRIOR ART)
FIG. 7 is a partial side view of the prior art.

To sum up the above, the baby bed is provided with a security fastening structure, which comprises the stopped components 14, the base member 2, and the stopping bars 23; after the baby bed has changed into the expanded position for use, the bottom stopping portions 232 of the stopping bars 23 will be propped on the fastening portions 141 of the stopped components 14 respectively so as to prevent the first and the second connecting rods 13 from pivoting upwards to change the baby bed into the folded configuration accidentally, as shown in FIG. 3. Thus, the baby bed is relatively firm without the possibility of the connecting rods 13 bouncing up. Then, a mattress can be positioned on the bottom of the baby bed. And, the stopping bars 23 will be moved to the non-fastening position when the pulling cord 235 is pulled upwards. The baby bed will be changed into the folded configuration if the user continues to pull the pulling cord 235 upwards after the stopping bars 23 has already been moved to the non-fastening position. Therefore, the baby bed can be easily folded merely by means of pulling the pulling cord 235 upwards; after the baby bed has been changed into the folded configuration, and the user stops pulling the pulling cord 235, the elastic element 234 will forced the stopping bars 23 to pivot back to their original position so that the upper operating ends 233 of the stopping bars 23 can be propped on the bottom propping portions 142 of the stopped components 14, as shown in FIG. 5.

From the above description, it can be seen that the baby bed of the present invention has the following advantages:

The stopping bars will contact the stopped components to prevent the connecting rods from bouncing away from the horizontal position when the baby bed is in the expanded in-use position. Therefore, the baby bed is relatively firm.

The baby bed can be changed into the folded configuration merely by means of pulling the pulling cord upwards. Therefore, the baby bed is relatively convenient to use as compared with the prior art.

What is claimed is:

1. A security fastening structure of a base of a baby bed, comprising a base member arranged on a middle portion of a bottom of a frame of a baby bed;

the frame including two connecting rods, which will extend along a common diagonal line of the bottom portion of the frame when the baby bed is in an expanded configuration;

two stopped components respectively joined to inward ends of the connecting rods, each stopped component having a contoured edge having a fastening portion and a propping portion spaced from the fastening portion;

a pair of stopping bars each being individually coupled to a portion of the base member on a common pivotal coupling member, each of the stopping bars having an upper operating end and a lower stopping portion, each of the lower stopping portions being elastically biased into engagement with a respective fastening portion of a corresponding stopped component when the stopped components are in a first position corresponding to the connecting rods being extended responsive to the baby bed being in the expanded configuration, the stopping bars being displaceable to release the stopping portions from engagement with the respective fastening portions of the stopped components so as to allow the baby bed to be changed into a folded configuration with the stopped components being rotatably displaced to a second position where the stopping portions are respectively disposed contiguous with the propping portions of the stopped components, each of the stopped components being rotatable from the second position to the first position responsive to the connecting rods being extended and the corresponding stopping portion of a respective stopping bar being slidably displaced relative to the stopped component along the contoured edge from the propping portion to the stopping portion thereof.

2. The security fastening structure of a base of a baby bed as claimed in claim 1, further comprising an elastic element disposed between the pair of stopping bars for applying a bias force thereto.

3. The security fastening structure of a base of a baby bed as claimed in claim 2, wherein the elastic element is disposed between the stopping portions of the pair of stopping bars.

* * * * *